United States Patent [19]

Huck, Jr. et al.

[11] Patent Number: 4,630,685

[45] Date of Patent: Dec. 23, 1986

[54] APPARATUS FOR CONTROLLING AN EARTHMOVING IMPLEMENT

[75] Inventors: Francis B. Huck, Jr., Peoria; David C. Janzen, Metamora, both of Ill.

[73] Assignee: Caterpillar Inc., Peoria, Ill.

[21] Appl. No.: 553,271

[22] Filed: Nov. 18, 1983

[51] Int. Cl.[4] ..... A01B 63/112; E02F 3/76

[52] U.S. Cl. ..... 172/7; 73/505; 172/2; 364/424

[58] Field of Search ..... 172/2, 3, 7, 9, 4, 4.5; 318/489, 587, 646, 648, 651; 73/505; 364/424

[56] References Cited

U.S. PATENT DOCUMENTS

| | | | |
|---|---|---|---|
| 3,546,948 | 12/1970 | Cook | 73/505 |
| 3,974,699 | 8/1976 | Morris et al. | 73/432 R |
| 4,157,118 | 6/1979 | Suganami et al. | 172/4.5 |
| 4,166,506 | 9/1979 | Tezuka et al. | 172/4.5 |
| 4,194,574 | 3/1980 | Benson et al. | 172/430 |
| 4,282,933 | 8/1981 | Suganami et al. | 172/7 X |
| 4,385,353 | 5/1983 | Schneider | 172/2 X |
| 4,423,785 | 1/1984 | Kurihara et al. | 172/3 |
| 4,518,044 | 5/1985 | Wiegardt et al. | 172/3 X |
| 4,535,847 | 8/1985 | Hasegawa et al. | 172/2 |

FOREIGN PATENT DOCUMENTS

| | | | |
|---|---|---|---|
| 2738771 | 3/1978 | Fed. Rep. of Germany . | |
| 3101736 | 2/1982 | Fed. Rep. of Germany . | |
| 55-78730 | 6/1980 | Japan | 172/7 |
| 57-17021 | 1/1982 | Japan | 172/2 |
| 81/02904 | 10/1981 | World Int. Prop. O. . | |

OTHER PUBLICATIONS

Publication entitled, "Tractor Earth Blading at High Speeds–Now a Reality", by E. T. Small, SAE Paper 998B, Jan. 1965.

"New Tricks for the Seabee Bulldozer", The Naval Civil Engineer–Fall, 1974, p. 42.

"Design of an Automatic Draft Power Controller for Bulldozers", SAE Technical Paper 821032 dated Sep. 13–16, 1982.

*Primary Examiner*—Richard T. Stouffer

*Attorney, Agent, or Firm*—Stephen L. Noe

[57] ABSTRACT

Earthmoving machines and earthmoving implements are difficult to operate to achieve maximum implement power and to control the implement under changing working conditions. The instant apparatus is designed to maximize implement power by automatically sensing and responding to variables related to implement power and to control the implement by automatically sensing and responding to the longitudinal angular velocity of the machine. The apparatus includes a mechanism for moving the implement in response to sensed variables related to implement power, a transducer for sensing the longitudinal angular velocity of the machine, and a control for modifying the implement position in response to the sensed angular velocity of the machine.

12 Claims, 7 Drawing Figures

APPARATUS FOR CONTROLLING AN EARTHMOVING IMPLEMENT

TECHNICAL FIELD

This invention relates generally to apparatus for controlling an implement and, more particularly, to apparatus for controlling, in response to working conditions, an earthmoving implement supported on an earthmoving machine.

BACKGROUND ART

Implements supported on machines, and the machines carrying the implements, should normally be operated to achieve maximum productivity. Earthmoving machines, and implements on these machines, are prime examples of such devices. The productivity or production rate for these machines can be defined as the volume of soil moved per unit time multiplied by the distance over which the soil is moved for a given working or soil condition environment. This, and other definitions of productivity, are known and used in the art. In machines and implements that are manipulated by a human operator, the skill of the operator is a practical limitation to attaining maximum productivity. Productivity usually is lower with unskilled operators than with skilled operators. For example, an unskilled operator may achieve as little as 65% of the productivity obtained by a highly skilled operator using the same machine.

Maximum productivity can be achieved by maximizing the "draft power" of the earthmoving machine. Draft power is the rate of actual useful work being done in moving the soil and is defined as the product of the draft force of the earthmoving implement and the ground speed of the earthmoving machine. A track/-wheel bulldozer and a bulldozer blade constitute one type of earthmoving machine and implement that moves or pushes soil. For these devices, draft force is the force on the blade and ground speed is the bulldozer ground speed.

A simple example of a working condition is the operation of the bulldozer to level an area. As the bulldozer starts forward with the blade elevated, draft power is zero since draft force is zero. As the blade is lowered and cuts into the soil, draft force increases and, hence, draft power increases. As the blade cuts deeper, draft force may continue to rise, but ground speed may decrease. Maximum draft power is reached when the bulldozer is moving at maximum ground speed commensurate with draft force.

Control systems have been developed that provide information for controlling the blade during various working conditions. These include control systems disclosed in (1) U.S. Pat. Nos. 4,194,574 by Benson et al., issued Mar. 25, 1980; (2) 4,166,506 by Tezuka et al., issued Sept. 4, 1979; and, (3) 4,157,118 by Suganami et al., issued June 5, 1979. A common problem with these control systems is the inability to adequately maintain stable blade control over the entire working area of the bulldozer. While stable blade control may be maintained when the bulldozer and blade are being operated over a substantially level or horizontal area, the problem arises when the bulldozer pitches forward into a cut and then pitches aft on ascending the other side of the cut. Upon pitching forward into the cut, the blade can quickly cut more deeply into the soil and become overloaded, and upon pitching aft the blade can move totally out of the soil and become unloaded or leave underneath a substantial amount of soil that had been carried during the cut. At the time of pitching, either forward or aft, the earthmoving machine has a substantial longitudinal angular velocity.

Whereas the information provided by the prior control systems may be useful for controlling the blade during the level portion of the cut, this information is not satisfactory for controlling the blade during the pitching conditions. For example, in U.S. Pat. No. 4,194,574, the information is an audible or visual representation of the blade power. The operator must respond to this data by manually moving a control lever to hydraulically raise the blade upon the forward pitching to compensate for the downward blade movement or to lower the blade upon aft pitching to compensate for the upward blade movement. Not only is the operator response to this information slow when a quicker response time is needed during the pitching conditions, but the operator can overshoot or undershoot the proper blade position, causing blade oscillation. Moreover, productivity is reduced during these pitching conditions because maximum blade power is not achieved.

Other disadvantages occur with the prior blade control systems, whether the bulldozer and blade are being controlled over a level area or during the pitching conditions. In U.S. Pat. No. 4,194,574, the control system senses blade force and bulldozer ground speed, and then calculates blade power. This information controls, for example, a variable rate audible signal generator whose audible tone rate varies as the calculated power changes. The operator must then manually move a control lever that controls a hydraulic actuator which, in turn, controls a lift cylinder that moves the blade. This manual control is performed in an attempt to achieve maximum blade power, which is indicated when a predetermined tone is produced by the signal generator.

One problem with the system of the '574 patent is the relatively quick onset of operator fatigue, both mental and physical, in responding to the alarm signal generator and moving the control lever to control the hydraulic actuator. For example, a percentage of operator lever control movement does not result in lift cylinder movement to reposition the blade. This is because the operator has not moved the control lever far enough to overcome cylinder pressure due to blade load. Also, a percentage of the control lever movements overshoot or undershoot the lever position corresponding to maximum blade power. Furthermore, the undercarriage life of the bulldozer is reduced owing to the occurrence of excessive and repeated track/wheel slippage, resulting in reduced ground speed, until the operator can manipulate the lever to again achieve maximum blade power.

In U.S. Pat. No. 4,166,506, the control system is designed to maintain a constant, predetermined load or force on the blade and not to control blade power. This is not sufficient to optimize productivity. This system senses the actual variable load, compare the sensed load to a predetermined fixed load, and produces control information to automatically raise or lower the blade in response to the comparison until the actual and predetermined loads are equal. The use of the predetermined fixed load also has the disadvantage of not allowing the operator to vary the setting of this important parameter which is directly related to blade power. The option to select a parameter directly related to blade power is beneficial when dictated by changing soil conditions and terrain irregularities. For example, for harder soil, it is beneficial to operate the blade under higher loads than the predetermined load.

The U.S. Pat. No. 4,157,118 has a control system in which the operator selects a desired or command blade height relative to the soil or depth of cut, which is then compared to the actual blade height according to sensed height data. The blade is then raised or lowered automatically until the command blade height and actual blade height are the same. Actual blade load is not sensed directly, but is calculated in response to engine speed and throttle opening and compared with a maximum preset load which is dictated by the particular working conditions. Should the load of the blade exceed the preset maximum load when the blade is at the commanded height, the control system overrides the height control and automatically causes the blade to rise until the actual load falls below the maximum load. As with the '506 patent, the control system of the '118 patent is not designed to control blade power, but rather blade height and maximum blade force or load. The latter, for example, may be preset too low if blade power were taken into consideration. Furthermore, the blade load control feature can function only to raise the blade and not to lower the blade.

The present invention is directed to overcoming one or more of the problems as set forth above.

DISCLOSURE OF THE INVENTION

In one aspect of the present invention, an apparatus controls an earthmoving implement of an earthmoving machine, wherein the earthmoving implement is movable to a plurality of positions and the earthmoving machine is movable at a longitudinal angular velocity, and includes means for sensing the angular velocity and moving the earthmoving implement in response to the sensed angular velocity.

Control systems producing implement control information do not provide stable control during critical working conditions when the earthmoving machine is pitching forward or aft into or out of a cut. Also, the control systems either are not designed to maximize blade power and, hence, productivity, or require manual implement control resulting in operator mental and physical fatigue. The present invention detects the longitudinal angular velocity of the earthmoving machine to compensate the position of the implement during pitching conditions, increasing blade stability and optimizing implement power and productivity by sensing at least one variable responsive to the power and automatically controlling the blade position in response to this variable.

BEST MODE FOR CARRYING OUT THE INVENTION

Figure 1:
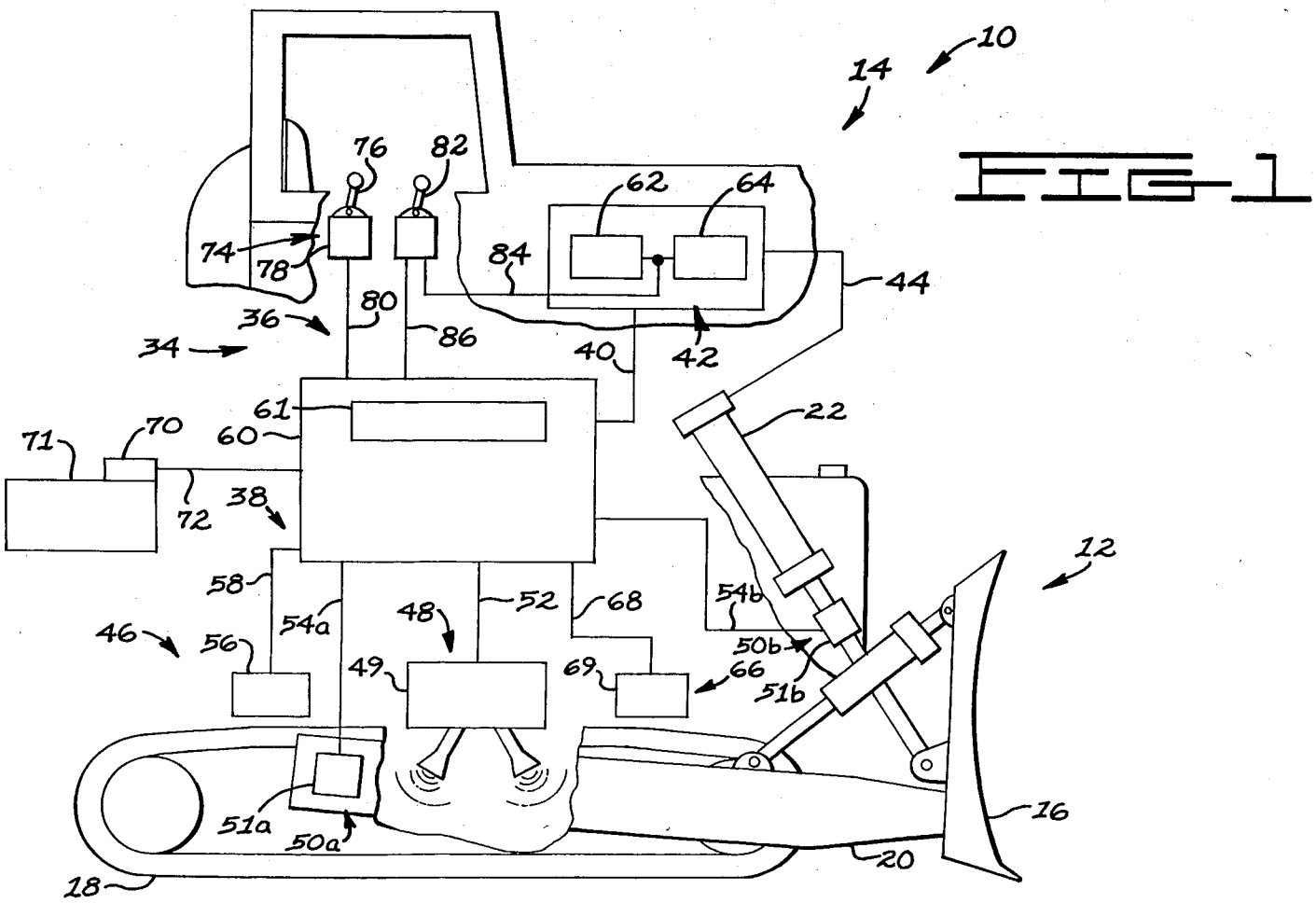
FIG. 1 is a side elevation of an earthmoving machine including an embodiment of the present invention.

FIG. 1 illustrates an earthmoving machine 10 having an earthmoving implement 12 used to move earth or soil. For example, the earthmoving machine 10 is a wheel or track-type bulldozer 14 and the earthmoving implement 12 is a bulldozer blade 16. The bulldozer 14 is shown as being a track-type machine having tracks 18, and includes a draft arm 20 connected to push the blade 16 and a lift cylinder 22 connected to raise and lower the blade 16. While the invention is described using the example of the bulldozer 14 and bulldozer blade 16, it is intended that the invention also be used on other types of earthmoving machines 10 and earthmoving implements 12.

Power applied to the blade 16 during earthmoving operations of the bulldozer 14 causes the blade 16 to push and carry the soil, occasionally slips the tracks 18, and overcomes friction and other losses, etc. A parameter known as draft or blade power "P" is a measure of the rate of actual useful work being done in moving the soil, and can be expressed by a simplified equation, as follows:

$P=F\times V$ where "F" is the draft or blade force of the blade 16, and "V" is the true ground speed or machine velocity of the bulldozer 14 relative to the ground. Maximum productivity is achieved by maintaining maximum power "P" on the blade 16 during earthmoving operations. For example, if the blade 16 is above the soil and blade force "F" is zero, or if the bulldozer 14 is stationary and ground speed "V" is zero, the draft power is zero. Between the extremes of zero blade force "F" and zero ground speed "V", a maximum value of draft power "P" exists, resulting in maximum productivity. For example, as the blade 16 is lowered by the cylinder 22 and cuts deeper into the soil, or as the blade 16 is raised towards the soil surface by the cylinder 22 and reduces the depth of the cut, the blade force "F" is higher or lower, respectively, for a given soil condition and ground speed "V".

Figure 7:
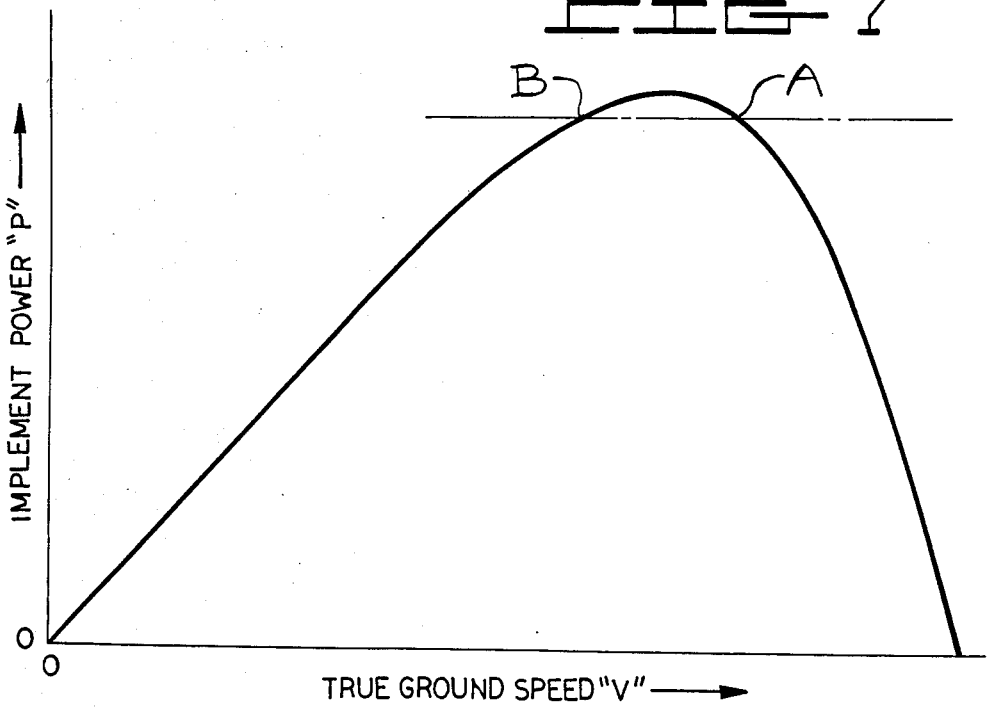

The relationship between ground speed "V" and draft or blade power "P" is shown in FIG. 7, where "P" is seen to peak between states "A" and "B". Operation on the curve between states "A" and "B" is desirable for maximum productivity. Raising the blade 16 while at state "B" or lowering the blade 16 while at state "A" causes the blade power "P" to approach the peak.

Because the blade 16 usually is raised and lowered by the cylinder 22 during the earthmoving operation in order to optimize blade power "P", blade stability is important. That is, in being moved by the cylinder 22 to a position corresponding to the position of maximum blade power "P", oscillation by the blade 16 about this optimum position should be minimized. Blade stability is highly important during the working conditions illustrated in FIGS. 2 and 3, to achieve both the general advantages of stable control and optimum blade power "P". These figures show the profile of a cut 26 into soil 28.

Figure 2:
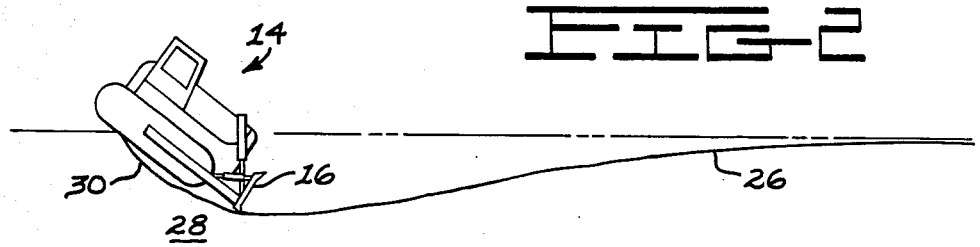
FIG. 2 is a view of the earthmoving machine pitching forward into a cut.

In FIG. 2, the bulldozer 14 and blade 16 are shown pitching forward into the cut 26 from the top 30. As this forward pitch occurs, the blade 16 quickly cuts deeper into the soil 28, increasing blade force "F" beyond a value appropriate for optimal blade power "P" at a given ground speed "V". As the bulldozer 14 rotates or pitches into the cut 26 in the direction shown by the arrow, the optimum blade force "F" changes quickly, and compensation should be made by raising the blade 16. A parameter identifying this forward pitching is the pitch rate or longitudinal angular velocity of the bulldozer 14. Stable positioning of the blade 16 is difficult when the bulldozer 14 has a high longitudinal angular velocity, as is present during this working condition.

Figure 3:
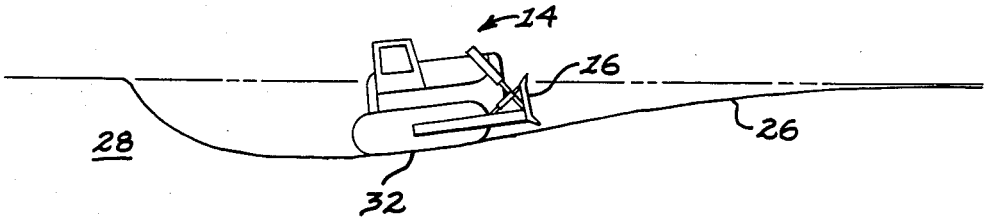
FIG. 3 is a view of the earthmoving machine pitching aft during exiting of the cut.

Similarly, in FIG. 3, the bulldozer 14 is shown as moving upwardly or ascending from a bottom 32 of the cut 26. As the bulldozer 14 pitches aft or in the rotational direction shown by the arrow, the blade 16 tends to move out of the soil 28, resulting in a decreasing blade force "F" and a reduced blade power "P" at a given ground speed "V". Moreover, as the blade 16 quickly raises, spillage of accumulated soil 28 beneath the cutting edge of the blade 16 occurs. Again, stable positioning of the blade 16 is difficult when the bulldozer 14 has a high longitudinal angular velocity during this working condition.

Adverting back to FIG. 1, an apparatus 34 is shown for controlling the earthmoving implement 12 of the machine 10, for example, the blade 16. The apparatus 34 provides stable blade control to compensate for the effects of pitching shown in FIGS. 2 and 3, and performs three distinct modes of operation or control, respectively called Underspeed Control, Ground Speed Control, and Blade Power Control, for optimizing blade power. The stable blade control feature is incorporated in all three modes.

The apparatus 34 includes means 36 for moving the blade 16 to a plurality of positions. The means 36 includes means 38 for automatically generating a blade position control signal and delivering the signal to a line 40. An actuatable means 42 of the means 36 responds to the position control signal received from the line 40 by producing and delivering a signal to an output line 44 which leads to the lift cylinder 22 and functions to raise or lower the blade 16.

The generating means 38 includes means 46 for sensing a variable directly related to at least one parameter of blade power "P", i.e., bulldozer ground speed "V" or blade force "F". The means 46 includes, for example, a ground speed sensor means 48 and draft or blade force sensor means 50*a,b*. The ground speed sensor means 48 senses the true ground speed "V" of the bulldozer 14 and produces and delivers a speed signal to a line 52 in response to the sensed ground speed "V". The draft or blade force sensor means 50*a,b* sense the force on the blade 16 and produce and delivers force signals to lines 54*a,b* in response to the sensed blade force "F".

The ground speed sensing means 48 is suitably positioned on the bulldozer 14 and includes, for example, a non-contacting ultrasonic or radar type sensor 49. The draft or blade force sensor means 50 includes, for example, strain gauges or load cells 51*a,b* suitably fixed to the lift cylinder 22 and the draft arm 20. As an alternative, and to estimate blade force "F", the sensor means 50 can, for example, be a driveline torque sensor which measures driveline torque and is located on a universal joint or other element in the driveline (not shown) for driving the tracks 18. In this alternative, torque measurements are combined with transmission gear ratios and the effective sprocket radius to convert the torque measurement to a tangential sprocket force which is an estimation of blade force "F". The sprocket force is modified to eliminate the gravitational component that appears when the bulldozer 14 traverses non-level terrain.

A pitch angle sensor means 56 of the means 38 is suitably supported on the bulldozer 14 to sense the nominal longitudinal pitch angle of the bulldozer 14 with respect to horizontal, for example, the ground line indicated in FIGS. 2 and 3. The sensor means 56 produces and delivers a pitch signal to an output line 58 in response to the pitch angle.

The means 38 also includes data processor means 60 for producing and delivering the position control signal to the line 40 in response to data signals received from the lines 52, 54 and 58. The data processor means 60 includes, for example, a Motorola MC6809 microprocessor 61 which is under software control.

The actuatable means 42 includes, for example, an electro-hydraulic actuator 62 that controls a hydraulic valve 64 in response to the control signal received from the line 40. The valve 64, in turn, controls the supply of hydraulic fluid delivered through the line 44 and utilized to raise and lower the cylinder 22.

The apparatus 34 also includes means 66 for sensing the longitudinal angular velocity of the bulldozer 14 and for producing and delivering an angular velocity signal to a line 68 in response to the sensed angular velocity. The means 66 is, for example, an accelerometer or pitch rate sensor 69. The data processor means 60 responds to receiving the signal from line 68 by modifying or compensating the moving means 38 to adjust any one position of the blade 16. In particular, in response to receiving the angular velocity signal from the line 68, the means 60 modifies the control signal of the line 40 that otherwise is produced in response to receiving the signals on the lines 52, 54, and 58.

A means 70 is connected to a transmission 71 of the bulldozer 14 and delivers forward and reverse direction signals to a line 72 in response to the transmission 71 being in a forward or reverse gear, respectively. In response to receiving the reverse direction signal, the data processor means 60 inhibits the delivery of control signals to the actuatable means 42.

To maintain an operator's control over the bulldozer 14, the apparatus 34 preferably includes, for example, means 74 for controllably modifying desired or command ground speed "V" or desired or command blade power "P". The means 74 includes a manual control member or lever 76. An encoder 78 senses the position of the lever 76 and produces and delivers a command signal to an output line 80 in response to either the selected command ground speed "V" or the selected command blade power "P". Alternatively, if operator control of these parameters is not desired, a command ground speed "V" or command blade power "P" can be preset at a predetermined level, for example by a thumbwheel or other settable control, or automatically calculated by the means 60 according to working conditions and apparatus 34 specifications. The command ground speed "V" or command blade power "P" is calculated, for example, by continuously monitoring the actual ground speed and actual blade force delivered to the means 60 from the sensing means 48,56 during an initial procedure wherein the operator drives the bulldozer 14 at a ground speed represented by the rightmost portion of the power curve depicted in FIG. 7. In response to the operator slowly lowering the blade 16 into the soil 28, blade power increases along the curve of FIG. 7 toward the peak power point and then decreases until the leftmost portion of the curve is reached, at which time the bulldozer 14 is stopped and the tracks 18 are in a full slip condition. The means 60 repeatedly calculates the actual blade power from the blade force/-ground speed relationship and the location of the peak power point on the curve of FIG. 7 is determined. This point establishes the command blade power "P" or command ground speed "V" according to actual working conditions.

The apparatus 34 also includes a means 82 that is coupled to the hydraulic valve 64 by a line 84 and manually controls the raising and lowering of the blade 16. The data processor means 60 is normally activated by a signal received over a line 86 in response to the lever 82 being in a neutral position.

In addition to storing and executing software instructions for carrying out the longitudinal angular velocity compensation feature mentioned above, the data processor means 60 stores and executes, for example, any one of three software programs "A", "B", and "C". Each program "A", "B", and "C" is used to support one distinct control or operational mode. Although the longitudinal angular velocity compensation feature is described as being used in conjunction with any one of the three modes, this feature can also be utilized independent of these three modes, for example, if only manual control via lever 82 is used but compensation is needed for the pitching conditions. The three modes described are designated as Underspeed Control—Program "A", Ground Speed Control—Program "B", and Blade Power Control—Program "C".

Figure 4:
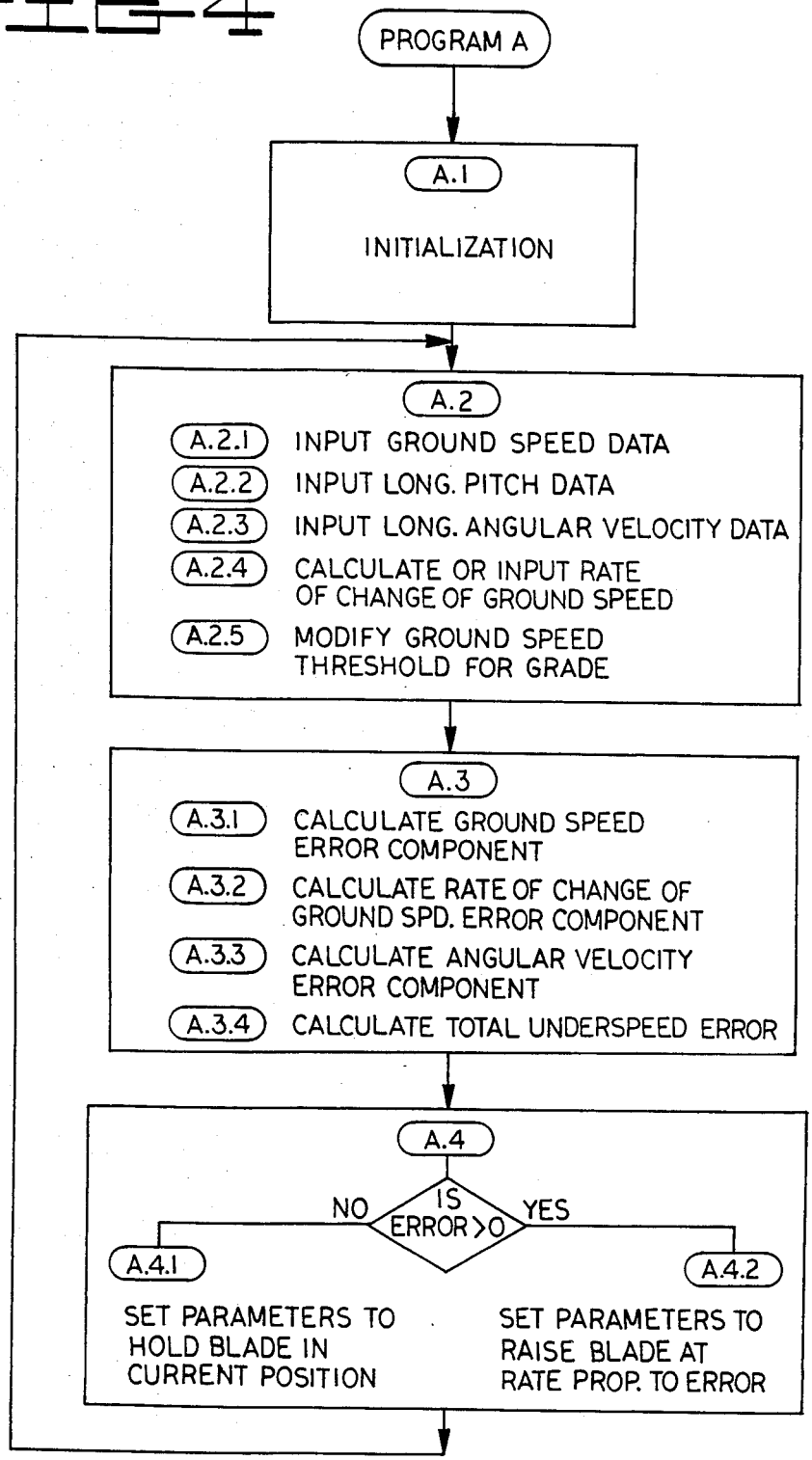
FIG. 4 is a flow chart used to explain one embodiment of the present invention.
Figure 5:
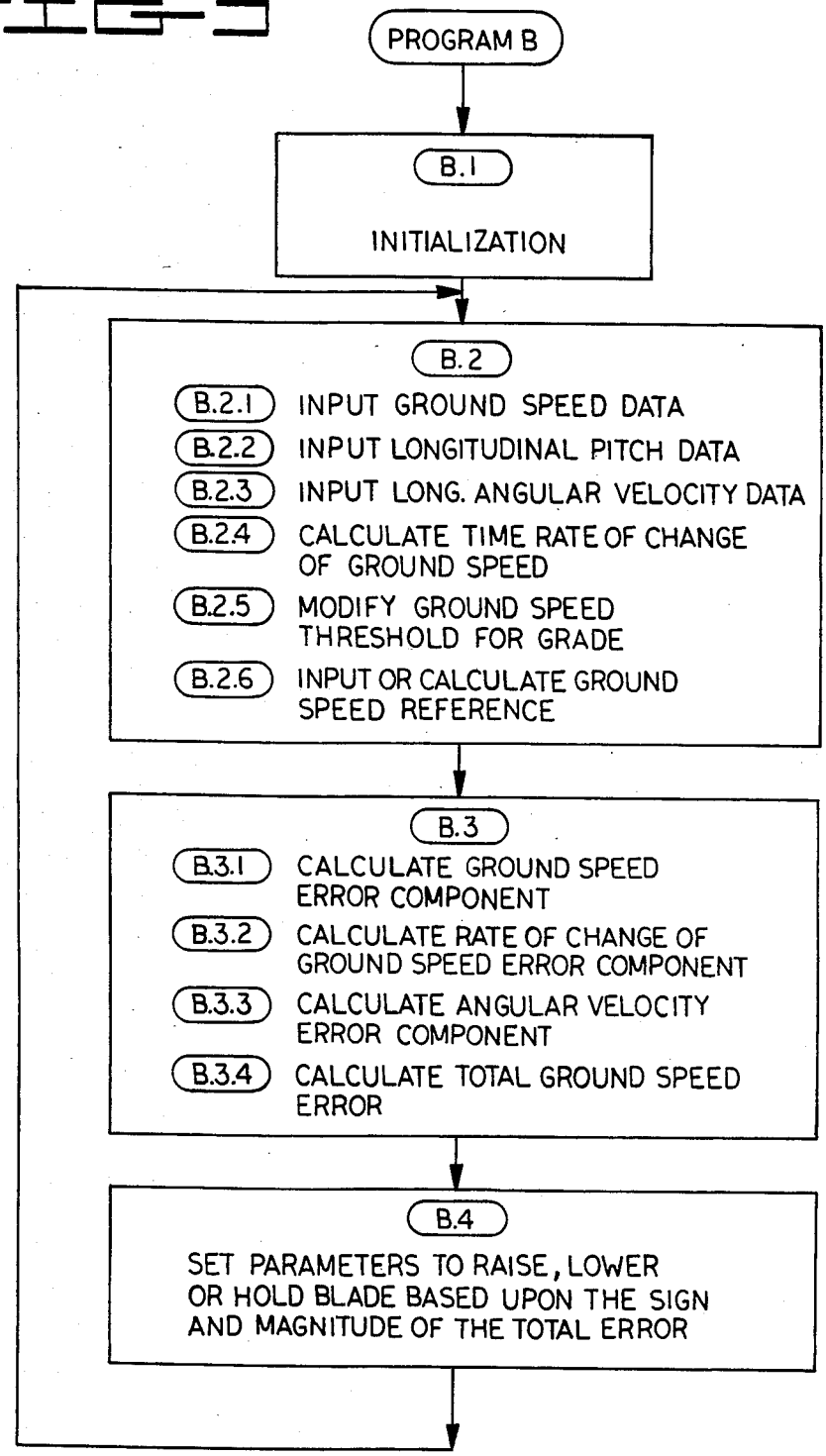
FIG. 5 is a flow chart used to explain a second embodiment of the present invention.
Figure 6:
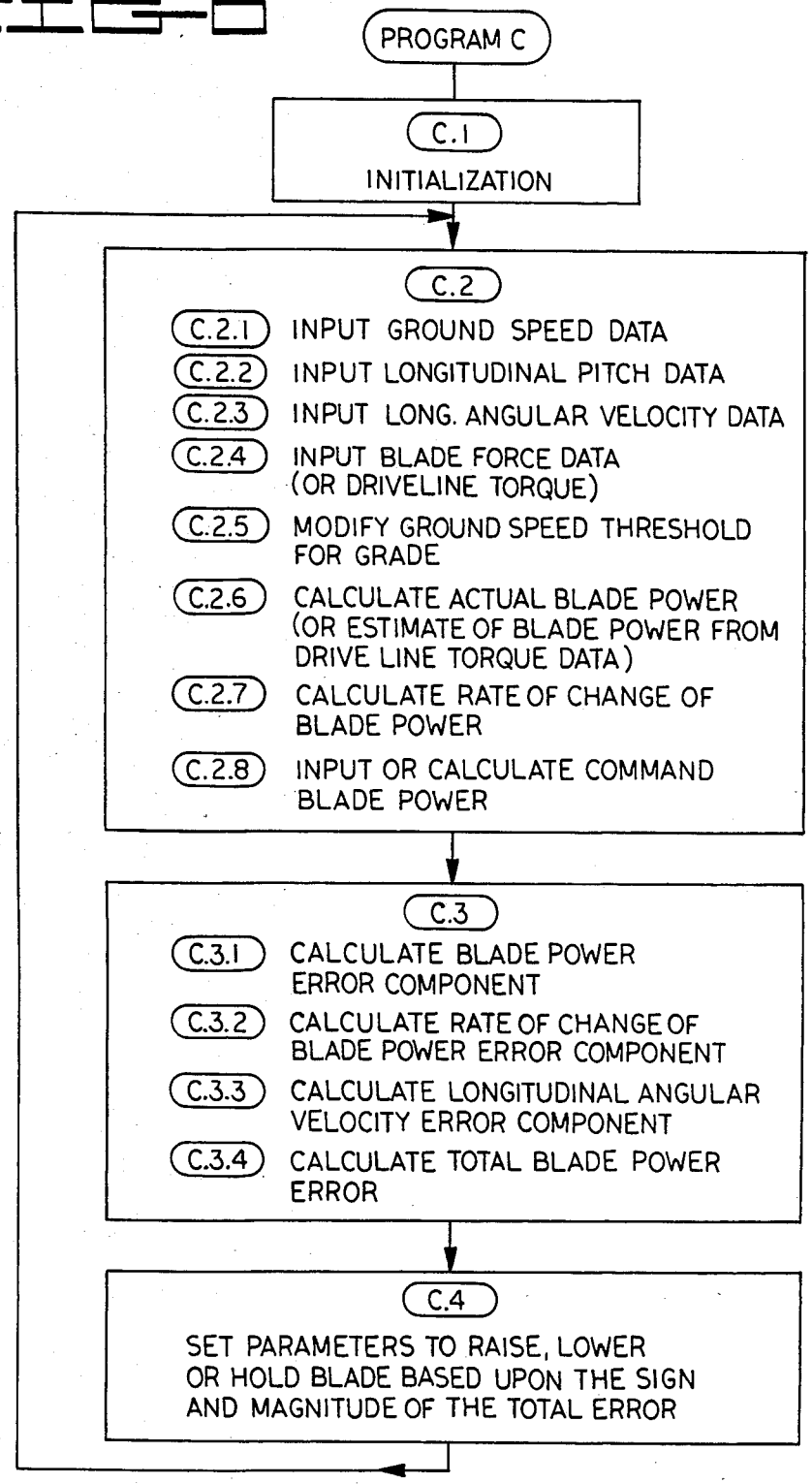
FIG. 6 is a flow chart used to explain a third embodiment of the present invention; and, FIG. 7 is a graphic representation of a typical ground speed v. implement power curve.

The functional flow charts depicted in FIGS. 4–6 are useful in developing a complete understanding of an implementation of the present invention. It will be appreciated that the actual coding of the software can vary according to the microprocessor 61 and other hardware selected, without deviating from the appended claims.

INDUSTRIAL APPLICABILITY

Underspeed Control—Program "A"—FIG. 4

Assume first that the bulldozer 14 is moving along a horizontal ground line without any track slippage. The bulldozer operator lowers the blade 16 to cut into the soil 28, using the manual control lever 82. The lever 82 is then placed in neutral to activate the data processor means 60, with the blade 16 remaining lowered. The ground speed sensor means 48 delivers the speed signal to line 52 in response to the ground speed "V", and the pitch angle sensor means 56 delivers the pitch signal to line 58 in response to the pitch angle.

If excessive slippage of the track 18 occurs, the ground speed sensor means 48 senses the reduced ground speed "V" and delivers a resultant speed signal to line 52 in response to the reduced speed. Excessive track slippage is a working condition resulting in loss of maximum blade power "P". Under control by program "A", and in response to the magnitude of the speed signal being less than a predetermined value, the data processor means 60 automatically generates and delivers a position control signal to line 40 which causes the actuatable means 42 to raise the blade 16. The blade 16 is raised until the data signal from line 52 identifies an increased ground speed "V" in response to substantially reduced track slippage.

Program "A" does not allow the blade 16 to be automatically lowered via any control signal on the line 40. Program "A" only generates and delivers a position control signal to line 40 that frees the blade 16 to be automatically raised. The bulldozer operator retains the option of raising or lowering the blade 16 in response to his moving the lever 82 from the neutral position. If the operator determines that the blade 16 can be lowered more deeply into the soil 28 without causing excessively reduced ground speed "V", the lever 82 is manipulated to lower the blade 16. Returning the lever 82 to its neutral position after lowering the blade 16 reactivates the data processor means 60.

Now assume that the bulldozer 14 is moving at a ground speed "V" without excessive track slippage, that the blade 16 has been partially lowered into the soil 28, and that the bulldozer 14 starts to pitch forward into the cut 26 created by the blade 16, as shown by numeral 30 in FIG. 2. During the initial portion of this forward pitching, failure to raise the blade 16 to compensate for this motion drives the blade 16 more deeply into the soil 28, resulting in a substantial, rapid and undesirable increase in blade force "F". The longitudinal angular velocity sensor means 66 senses this forward pitching and delivers an angular velocity signal to line 68 in response to the rate of pitching. The data processor means 60, in response to receiving the data signal from line 68, modifies the position control signal that is delivered to line 40 in response to the data signals from lines 52, 58 and causes the actuatable means 42 to raise the blade 16 to a position to compensate for this angular velocity, and reduces blade force "F". When the angular velocity has substantially ceased and the bulldozer 14 is moving towards the bottom 32 of the cut 26, the blade 16 position is again governed primarily in response to the ground speed data.

As the bulldozer 14 moves away from the bottom 32 and ascends the cut 26, as shown in FIG. 3, it pitches aft with reduced ground speed "V" and causes the blade 16 to be raised out of the soil 28. Under this condition, the blade 16 should be lowered relative to the bulldozer 14 to prevent spillage of accumulated soil beneath the blade 16. Although program "A" does not automatically lower the blade 16, the means 60 responds to the longitudinal angular velocity signal from line 68 by modifying the control signal to line 40 to reduce the tendency of the blade 16 to be raised in response to the reduced ground speed signal from line 52.

The Underspeed Control Process of FIG. 4, executed by the data processor means 60, may be characterized by the mathematical algorithm or feedback error relationship given by the following equation:

$$E_{us}=\delta\cdot[K_1(\dot{V}_{REF}(\dot{\theta})-V_{TGS})-K_2(V_{TGS})+K_3(\theta)]$$

where:

$E_{us}$ is the total Underspeed Control error signal $V_{REF}(\theta)$ is the ground speed reference threshold which is a function of $\theta$ the longitudinal pitch angle $\dot{V}_{TGS}$ is the actual ground speed $V_{TGS}$ is the actual time rate of change of ground speed $\dot{\theta}$ is the longitudinal angular velocity $K_1$, $1K_2$, & $K_3$ are adjustable, positive gain parameters $$\delta=\begin{cases}0\\1\end{cases}\text{ if the quantity in square brackets [ ] is }\begin{cases}\leq 0\\>0\end{cases}$$

Note that $\theta$ and $\theta$ are defined to have positive values when the tractor is forwardly pitched on a downgrade and forwardly pitching toward a lesser grade, respectively.

In all three control modes, the magnitude of the error determines the rate at which the blade position is adjusted. The sign of the error determines the direction. Positive errors result in a raise correction while negative errors produce a lowering correction. A null or zero value for the error causes the blade 16 to be held in its current position.

The Underspeed Control is designed to only raise or hold the blade. Corrections to lower the blade are precluded by the presence of the delta ($\delta$) parameter. A control mode based purely upon the longitudinal angular velocity is obtained by setting the gain parameters $K_1$ & $K_2$ to zero.

Ground Speed Control—Program "B"—FIG. 5

In this mode, the lever 82 is in neutral and activates the data processor means 60. The operator rotates the lever 76 over a predetermined range and selects a desired or command ground speed "V" for the bulldozer 14. The encoder 78 senses the position of the lever 76 and delivers to line 80 a predetermined command signal responsive to the command ground speed "V". As discussed previously, the predetermined command signal can likewise be a preset value or can be automatically calculated by the means 60.

With the bulldozer 14 in motion, the data processor means 60 receives the speed signal from line 52, the pitch angle signal from line 58, and the command signal from line 80. In response to these signals, and under control of program "B", the data processor means 60 generates and delivers position control signals to line 40, which cause the actuatable means 42 to automatically raise and lower the blade 16 in the soil 28. The blade 16 is automatically raised in response to the magnitude of the speed signal being less than the predetermined command signal value, just as in the Underspeed Control, but the blade 16 is also automatically lowered in response to the magnitude of the speed signal being greater than the predetermined command signal value. This frees the bulldozer 14 to continue to move at the desired or command ground speed "V".

In the embodiment including the lever 76, the operator modifies the ground speed command at any time by repositioning the lever 76 in response to changes in the working conditions, such as terrain profile and soil properties. In response to selection of a different command ground speed "V", a different command signal is produced and delivered to line 80. The data processor means 60 responds, under control of program "B", to the new command signal from line 80 and the speed signal from line 52, by producing and delivering a different position control signal to line 40 which in turn causes the actuatable means 42 to raise or lower the blade 16. In response to the actual ground speed and the command ground speed being substantially the same, i.e., the error is substantially zero, the data processor means 60 delivers a control signal to line 40 which controls the actuatable means 42 and maintains the blade 16 at the current position.

As described in the Underspeed Control mode, the longitudinal angular velocity sensor means 66 and the data processor means 60 compensate or modify the position of the blade 16 in response to changes in pitch of the bulldozer 14. This compensation is performed independent of operator control or manipulation of the lever 76. The operator maintains the option of manually controlling the blade 16 by manipulating the lever 82 from its neutral position.

The Ground Speed Control process of FIG. 5, executed by the data processor means 60, may be characterized by the following algorithm or feedback error relationship:

$$E_{GS}=K_1(V_{OR}(\theta)-V_{TGS})+K_2\cdot(V_{OR}-\dot{V}_{TGS})+K_3(\dot{\theta})$$

where:

$E_{GS}$ is the total Ground Speed Control error signal $V_{OR}(\theta)$ is the command ground speed which is a function of the longitudinal pitch angle $\dot{V}_{OR}(\theta)$ is the command time rate of change of ground speed $V_{TGS}$ is the actual ground speed $\dot{V}_{TGS}$ is the actual time rate of change of ground speed $\dot{\theta}$ is the longitudinal angular velocity $K_1$, $K_2$, & $K_3$ are adjustable, positive gain parameters The Ground Speed Control algorithm permits positive, zero, and negative values of $E_{GS}$.

Blade Power Control—Program "C"—FIG. 6

In this mode, the lever 82 is in neutral to activate the data processor means 60. The operator rotates the lever 76 over a predetermined range and selects a desired or command blade power "P". The encoder 78 senses the position of the lever 76 and delivers to line 80 a predetermined command signal in response to the command blade power "P". The range of positioning of the lever 76 for selecting command blade power "P" is different than the range of positioning of the lever 76 for selecting command ground speed "V". As discussed previously, the predetermined command signal can likewise be a preset value or can be automatically calculated by the means 60.

With the bulldozer 14 in motion, the data processor means 60 receives the speed signal from line 52, the pitch angle signal from line 58, the blade force signal from line 54, and the command signal from line 80.

In response to the signals from lines 52, 58, and 54, and under control of program "C", the data processor means 60 determines actual blade power and compares this with the predetermined command signal value. The data processor means 60 then produces and delivers position control signals to line 40 and causes the actuatable means 42 to raise or lower the blade 16 until the determined blade power and the command blade power are substantially the same.

In the embodiment including the lever 76, the operator modifies the blade power selection at any time by repositioning the lever 76 in response to changes in the working conditions, such as terrain profile and soil properties. In response to selection of a different command blade power, a different predetermined command signal is delivered to line 80. The data processor means 60 responds, under control of program "C", by producing and delivering a different position control signal to line 40, and causes the actuatable means 40 to raise or lower the blade 16. In response to the actual blade power and the command blade power being substantially the same, i.e., the error is substantially zero, the data processor means 60 delivers a control signal to line 40 for controlling the actuatable means 42 and maintaining the blade 16 at the current position.

As described in the Underspeed Control and the Ground Speed Control, the longitudinal angular velocity sensor means 66 and the means 60 compensate or modify the position of the blade 16 in response to changes in pitch of the bulldozer 14. This compensation is performed independent of operator control or manipulation of the lever 76. The operator maintains the option of manually controlling the blade 16 by manipulating the lever 82 from its neutral position.

The Blade Power Control process of FIG. 6, executed by the data processor means 60, may be characterized by the following algorithm or feedback error relationship:

$$E_{BP}=V_{POL}\cdot[K_1(\dot{B}P_{ACT}-\dot{B}P_{REQ})+K_2\cdot(BP_{ACT}-BP_{REQ})]+K_3(V_{BIAS})+K_4(\dot{\theta})$$

where $BP_{ACT}$ is the actual blade power (or estimated from driveline torque x ground speed)

$\dot{B}P_{ACT}$ is the time rate of change of blade power $\dot{B}P_{REQ}$ is the command blade power $\dot{B}P_{REQ}$ is the time rate of change of command blade power $$V_{POL}=\begin{cases}+1 \text{ if } V_{TGS}>V_{REF}(\theta)+\Delta V\\ 0 \text{ if } |V_{TGS}-V_{REF}(\theta)|\leqq\Delta V\\ -1 \text{ if } V_{TGS}<V_{REF}(\theta)-\Delta V\end{cases}$$

where:

$V_{TGS}$ is the true ground speed $V_{REF}(\theta)$ is the ground speed at peak power, and $\Delta V$ is a deadband velocity around $V_{REF}(\theta)$ $$V_{BIAS}=\begin{cases}0 \text{ if } V_{TGS}\geqq V_{REF}(\theta)\\ V_{REF}(\theta)-V_{TGS} \text{ if } V_{TGS}<V_{REF}(\theta)\end{cases}$$

$\dot{\theta}$ is the longitudinal pitch rate of the tractor. $K_1$, $K_2$, $K_3$, & $K_4$ are positive gain parameters.

The factor, $V_{POL}$, which multiplies the first two terms in Equation 3 inverts the polarity of the error signal $E_{BP}$ when the ground speed falls below that speed associated with the peak in the power vs. ground speed relationship (shown in FIG. 7). For a typical reference power, the machine 10 can exist in two distinct states, "A" and "B". The direction of blade correction required for a given blade power error is opposite for the two states. The term $V_{BIAS}$ biases the system toward state "A" of FIG. 7, the more stable of the two system states.

In summary, stable implement control is maintained over all working conditions of the earthmoving machine 10, and in particular during pitching conditions, by compensating or modifying the blade position in response to the longitudinal angular velocity of the machine. Productivity is substantially enhanced by controlling the implement 12 in response to sensed variables directly related to implement power, including at least machine ground speed for the Underspeed Control and Ground Speed Control modes, and machine ground speed and implement force for the Implement Power Control mode. Operator mental and physical fatigue are reduced since the apparatus 34 automatically moves the implement 12, yet the operator retains control of the machine 10 by manipulating the lever 76 and/or the lever 82. Furthermore, the apparatus 34, being automatic, shortens the time required to react to changing working conditions. Additionally, by sensing machine ground speed, the apparatus 34 enhances the life of the machine undercarriage by controlling the implement 12 and effectively preventing excess track or wheel slippage in response to high implement loads.

Other aspects, objects and advantages of this invention can be obtained from a study of the drawings, the disclosure and the appended claims.

We claim:

1. In an apparatus for controlling an earthmoving implement of an earthmoving machine, said earthmoving machine being movable at a longitudinal angular velocity and said earthmoving implement being movable to a plurality of up/down positions, said apparatus including actuatable means for controllably raising and lowering said earthmoving implement to any of said plurality of positions, the improvement comprising:

means for sensing longitudinal angular velocity and producing an angular velocity signal in response to said sensed longitudinal angular velocity; and means for receiving said angular velocity signal and controlling said actuatable means in response to said received angular velocity signal.

2. An apparatus, as set forth in claim 1, including means for sensing the ground speed of said earthmoving machine and generating a speed signal in response to said sensed ground speed;

means for manually controlling said actuatable means and raising and lowering said earthmoving implement; and, means for receiving said speed signal, automatically controlling said actuatable means and raising said earthmoving implement in response to the magnitude of said speed signal being less than a predetermined value.

3. An apparatus, as set forth in claim 2, wherein said means for automatically controlling said actuatable means for lowering said earthmoving implement in response to the magnitude of said speed signal being greater than said predetermined value.

4. An apparatus, as set forth in claim 3, including means for controllably modifying said predetermined value.

5. An apparatus, as set forth in claim 4, wherein said modifying means includes a manual control member.

6. An apparatus, as set forth in claim 1, including means for sensing a force applied to said implement and generating a force signal in response to said sensed force;

means for sensing the ground speed of said earthmoving machine and generating a speed signal in response to said sensed ground speed; and, means for determining the actual implement power in response to said force and speed signals and automatically controlling said actuatable means for respectively raising and lowering said earthmoving implement in response to the magnitude of said actual implement power being greater than and less than a predetermined value.

7. An apparatus, as set forth in claim 6, including means for controllably modifying said predetermined value.

8. An apparatus, as set forth in claim 7, wherein said modifying means includes a manual control member.

9. Apparatus for controlling an earthmoving implement of an earthmoving machine, comprising:

actuatable means for moving said earthmoving implement to a plurality of up/down positions in response to receiving a control signal;

means for sensing the ground speed of said earthmoving machine and generating a speed signal in response to said sensed ground speed;

means for sensing a force applied to said implement and generating a force signal in response to said sensed force;

means for controllably producing one of a predetermined command ground speed and command implement power signal;

means for receiving said speed signal, said force signal, and said command signal, producing said control signal in response to said received signals, and delivering said control signal to said actuatable means;

means for sensing the longitudinal angular velocity of said earthmoving machine and responsively producing an angular velocity signal; and, means for receiving said angular velocity signal and responsively modifying said control signal.

10. Apparatus, as set forth in claim 9, wherein said command signal producing means includes a manual control member being movable to a range of command ground speed positions and a range of command implement power positions.

11. Apparatus, as set forth in claim 9, wherein said control signal producing means includes a software programmed microprocessor.

12. Apparatus, as set forth in claim 9, including means for producing forward and reverse direction signals and delivering said direction signals to said modifying means; and, wherein said modifying means inhibits the delivery of said control signal to said actuatable means in response to receiving said reverse direction signal.

* * * * *